United States Patent [19]

Lister

[11] 4,317,966

[45] Mar. 2, 1982

[54] VIBRATORY RIBBON SPEAKER

[76] Inventor: Clive R. B. Lister, P.O. Box 5101 (University Station), Seattle, Wash. 98105

[21] Appl. No.: 122,696

[22] Filed: Feb. 19, 1980

[51] Int. Cl.[3] ..... H04R 9/02

[52] U.S. Cl. ..... 179/115 V

[58] Field of Search ..... 179/115 V

[56] References Cited

U.S. PATENT DOCUMENTS 2,233,886 3/1941 Cowley et al. ..... 179/115 V

FOREIGN PATENT DOCUMENTS 1184382 12/1964 Fed. Rep. of Germany ... 179/115 V
32649 2/1928 France ..... 179/115 V
674470 6/1952 United Kingdom ..... 179/115 V
810064 3/1959 United Kingdom ..... 179/115 V

*Primary Examiner*—George G. Stellar
*Attorney, Agent, or Firm*—Ford E. Smith; David L. Garrison

[57] ABSTRACT

A vibratory ribbon speaker according to this invention as disclosed comprises a series of permanent magnets secured on opposite faces of a pair of soft iron bars mounted in edge-opposed, spaced-apart relation providing an air return flux path and a working air gap in which is suspended an elongated wavy or corrugated non-magnetic ribbon, several feet in length, flexibly and resiliently supported in said air gap at numerous spaced-apart stations along the ribbon length.

15 Claims, 11 Drawing Figures

VIBRATORY RIBBON SPEAKER

SUMMARY OF THE INVENTION

Vibratory ribbon speakers of considerable length are presently known only as assemblies of modules. Those with transversely wavy or corrugated configurations and formed desirably of lightweight metal ribbons are of limited length due to the inherent impracticability of precisely suspending a ribbon of such configuration having a length of several feet, e.g., four to six feet. At the same time there is a serious and attendant problem of providing high magnetic flux in a working air gap capable of accommodating such a ribbon. In this respect resort to conventional magnetic means providing an elongated air gap attain enormous bulk and weight of such magnitude as to defeat their use in home or domestic speakers. According to this invention the latter problem is overcome by using pluralities of ceramic permanent magnets serially secured to upright soft iron carrier bars suitable for mounting in aesthetically acceptable non-bulky or unsightly cabinetry. The problem of employing a corrugated or wavy ribbon of considerable length is overcome by resiliently and flexibly supporting the ribbon in said working gap at numerous spaced-apart stations along its length, thus avoiding sagging due to weight increase as the distance from the overhead support increases. This arrangement also permits non-uniform spacing of the resilient supports along the longitudinal dimension of the ribbon to permit avoidance or prevention of the generation of undesirable traveling waves in the vibrating ribbon.

DESCRIPTION OF THE INVENTION

Figure 1:
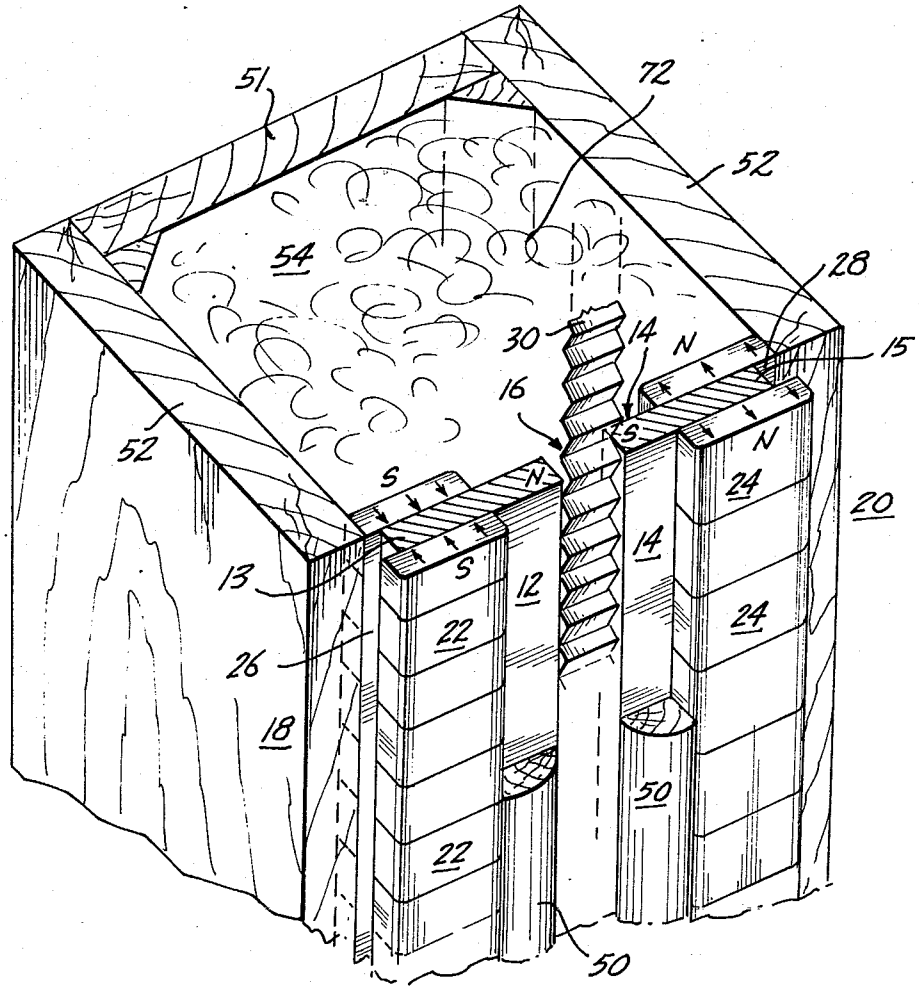
FIG. 1 is a partial view showing in perspective the principal functioning elements of my ribbon-type acoustic speaker system.

In FIG. 1 is shown a preferred form of a ribbon-type, high fidelity, sound-reproducing loudspeaker equipment comprising an opposed pair of elongated upright ferrous magnetic bars 12 and 14, spaced apart along their opposed edges to provide gap 16 disposed in the axis formed thereby and to constitute pole pieces in the system. Bar 12 at the edge along gap 16 is a north N pole piece and opposed bar 14 along gap 16 comprise a south S pole piece in the system.

Bars 12 and 14, along their edges remote from gap 16 comprise respectively S and N pole pieces in the system due to the magnetic flux patterns created by the two series 18 and 20 of block magnets 22 and 24. It is preferred that magnets 22 and 24 be formed as separate elements of ceramic permanently magnetic material well known to provide high coercive forces without undue weight in magnetic systems. Magnets in opposed matching pairs sandwich along the said remote edges thereof, at a location spaced from the working gap pole pieces 12 and 14. In the illustrated system the magnet series 18 and bar 12 constitutes the S pole piece of the system and the magnet series 20 similarly but oppositely together with bar 14 constitutes the N pole piece of the system.

While the outer edges of magnet series 18 and 20 may be arranged flush with the outer or remote edges 13 and 15 of bars 12 and 14 respectively, I have found that, by allowing them to overlap said edges, longitudinal grooves 26 and 28 respectively are formed to tend to reduce leakage flux in the system.

The permanent magnet blocks 22 and 24 of series 18 and 20 are magnetized in directions perpendicular to the transverse axes of bars 12 and 14 as shown by appropriate arrows in FIG. 1.

The magnet blocks 22 and 24 are securely mounted to their respective bars 12 and 14 by adhesive means interposed between the magnets and the bars. Any long-lived adhesive material operable to bond ceramic material to metal is suitable for use in this system. Rapid bonding assists in the orderly assembly of the magnetized blocks.

Figure 2:
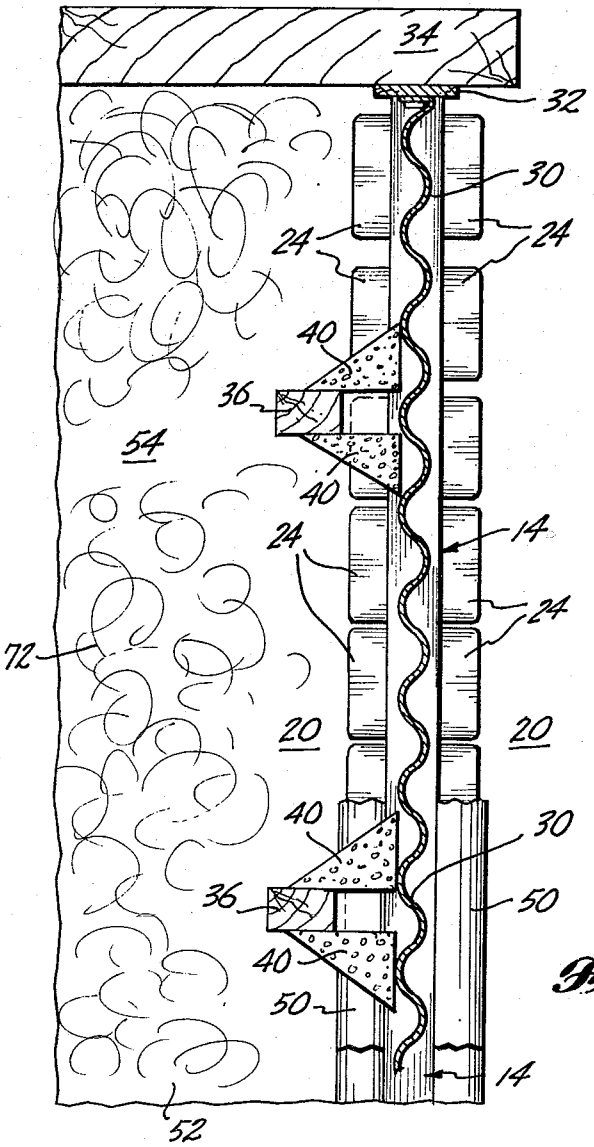
FIG. 2 is a vertical sectional view of the upper portion of an acoustic speaker case embodying my ribbon-type apparatus.

The wavy or corrugated ribbon 30 is disposed along the longitudinal axis of air gap 16 as shown. Referring to FIG. 2, the upper end of the suspended ribbon 30 will be seen to be attached by fixture 32 to the underside of speaker cover 34. On bar 14 is mounted the magnets 24 of series 20, the lower magnets being in edge-to-edge contact while the upper magnets of series 20 are in spaced-apart relation for purposes to be discussed later.

The corrugated ribbon conductor 30 of FIG. 1 is shown as preformed in a zig-zag pattern by being passed between interfitted, gear-like rotary members (not shown). Alternatively, the ribbon conductor 30 may be similarly preformed into a sine wave pattern. In either instance the ribbon conductor, in addition to the described overhead suspension means requires further apparatus to support it precisely in air gap 16. Such means is shown in FIGS. 2, 4, 5, 6, 7 and 8.

Figures 3, 4, 5, 6, 7, 8, 9, 10, 11:
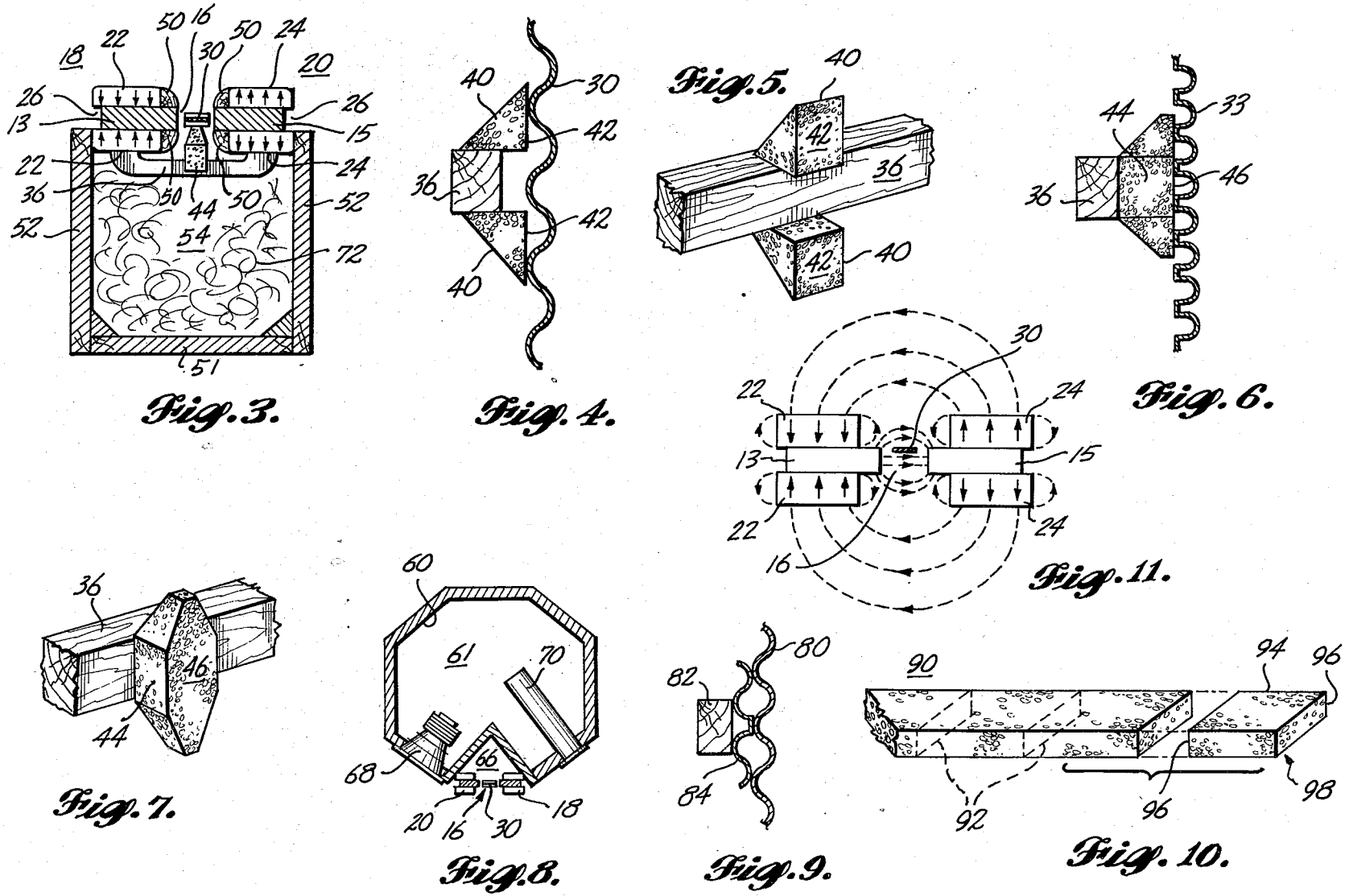
FIG. 3 is a transverse cross-sectional view of an acoustic speaker case embodying my invention.
FIGS. 4 and 5 show in vertical section and perspectively one form of apparatus for supporting an upright wavy sound-reproducing ribbon.
FIGS. 6 and 7 similarly show an alternative form of ribbon-supporting apparatus.
FIG. 8 is a transverse sectional view across another form of acoustic speaker case housing my ribbon speaker system.
FIG. 9 shows alternative apparatus for supporting the wavy acoustic ribbon.
FIG. 10 illustrates a method of producing ribbon supporting blocks of FIGS. 6 and 7.
FIG. 11 shows how the pole pieces concentrate flux in the working gap while the return flux spreads through acoustically useful air volumes.

Cross bars 36, best seen in FIG. 2, constitute support stations. They span the chamber 54 behind the magnet system and cross the air gap 16. Bars 36 may be of wood or other non-magnetic material. Referring to FIGS. 4 and 5 it will be observed that triangular-shaped resilient blocks 40 are adhesively secured in overhanging relation atop and below cross bar 36 so that faces 42 are disposed forwardly of the bar to the plane in which lies several crests of the wavy ribbon 30. Blocks 40 and the contacted crests of ribbon 30 are adhesively joined.

Blocks 40 are resilient and preferably are cut from polyurethane foam material or derived from a felt of fibers. The amount of overhang of blocks 40 may be varied during assembly. Their function is to resiliently support spaced-apart sections of the suspended ribbon 30 in precise chosen location in air gap 16.

In FIGS. 6 and 7 blocks 44 of alternative shape are shown as attached to the front face of bar 36 and, as above, have each block front face 46 attached to crests at the backside of ribbon 33, the same being shown here as of a different form of wavy pattern.

While the means for supporting the resilient pads at the backside of the ribbon are preferably cross bars 36, it will be apparent that other forms of support means may be employed without departing from this inventive concept. It is also to be borne in mind that the support station for the ribbon need not be uniformly spaced apart. For example, graduated spacing of the supports from the center to the ribbon ends may be arranged with increasing or decreasing spacing employed to combat travelling wave distortions.

Referring to FIG. 10, a simple alternative support is made from a strip 90 of uniformly thick resilient material such as polyurethane foam which is cut on diagonal lines 92 indicated in phantom. When strip 90 is cut as indicated, diamond or lozenge-shaped supports 94 having highly resilient tapered ends 96 and a relatively more firm mid-section 98 are produced. Supports 94 may be used as cut or they may be further trimmed to the shapes of FIGS. 6 and 7.

The intermediate resilient supports, either blocks 40, 44, or 94 spaced apart along the rear of the long continuous ribbon stabilize the ribbon in desired location in the air gap 16. Blocks 40 or 44 being formed of resilient, low-density and elastically capable material serve to enhance the high-frequency output of the sound-reproducing ribbon relative to the lower frequencies and to counteract the cylindrical source fall-off of 3 db per octave which otherwise would occur.

The tapered ends of blocks 40 and 44 either physically or by density variation provide a lengthwise gradation which permits absorption of unwanted traveling waves in the ribbon and thus prevents reflection of any traveling waves within ribbon 30. This serves to materially reduce if not eliminate distortion caused by traveling waves. Resilience in the mounts further functions to combat ribbon fatigue during operation.

To summarize, this ribbon-mounting system provides unrestricted ribbon movement at the highest frequencies for true line source while at the lower frequencies the deleterious effects of traveling waves are absorbed for high-fidelity operation of the speaker system and long ribbon life.

By securing the ends of the spaced-apart bars 36 to the back side of the opposed magnetic pole pieces 18 and 20, the attraction forces of the pole pieces tending to bring them together and to close air gap 16 are counteracted.

In FIGS. 1 and 3 are shown wooden quarter-round fairing strips 50 mounted on bars 12 and 14 along the edges of the air gap 16. These fairing strips serve to smooth paths of reproduced sounds emanating from the acoustic ribbon 30.

A typical housing, indicated in FIGS. 2 and 3, comprises a back wall 51, side walls 52,52, top or cover 34, and a base plate (not shown) to close the bottom of the assembly. The housing preferably has no front wall, the ribbon backing chamber 54 being closed at the front by the sound reproducing apparatus previously described and as shown in FIGS. 1 and 3.

It is generally recognized that acoustic ribbon systems, wherein a ribbon of practical size is employed, tend not to satisfactorily reproduce a full audio band width. Such deficiency generally in the low frequencies may be overcome by a cross-over to other drivers being made at convenient frequencies. A stacked plurality of small drivers disposed as closely parallel as possible to the ribbon will improve the low frequency 50 Hz–700 Hz output. Good results are obtained if the wave length of sound at the cross-over frequency is substantially longer than the separation of the ribbon and the low-frequency drivers.

The octagonal elongated upright enclosure 60 shown in FIG. 8 comprises a pair of walls joined to form a triangular chamber 66 in the front of which is a vibrating ribbon sound-reproducing assembly embodying this invention. A row of conventional conical drivers 68 is arranged alongside the ribbon assembly, spaced at less than one-half wave length of the cross-over frequency of, for example, 700 Hz or about 9 inches. Such drivers accommodate the lower frequencies and improve the range of the speaker system. Also a series of tubular non-driven resonators 70 may be mounted in a wall of the cabinet 60 to further enhance audio output in the very low frequencies, of, say, 30 Hz–40 Hz.

As is usual in speaker operation, the chambers 54 of FIGS. 1 and 3 and chamber 61 of the enclosure of 60 of FIG. 8 may be filled with an acoustically absorbent material 72—fiberglass in loose fill or batt form being typical.

FIG. 9 shows an alternative means for supporting the acoustic ribbon 80. Cross bar 82 supports the flexible but non-absorbent support 84 which is adhesively or otherwise bonded to a crest at the backside of ribbon 80.

Ribbon 30 may be of lightweight aluminum foil of considerable length and a thickness suitable to hold a wavy form. Preferably the ribbon is transversely narrow to obtain wide beam dispersion. When the width of the ribbon is less than one-half the wavelength of the highest frequency, e.g., 8 mm $\frac{1}{2}\lambda$ at 20 KHz good response is obtained. The ribbon 30 generally vibrates in a fore-and-aft direction in the air gap 16, vibration being caused by interaction between electric currents in the ribbon and the magnetic flux between the N and S pole pieces 12 and 14 defining the air gap.

As shown in FIG. 11, the magnetic lines of force are concentrated in gap 16 by the magnetically soft pole pieces 12 and 14. The principal departure from previous practice is the lack of a massive and bulky ferous return path for the flux. Instead, the return flux expands through acoustically useful airspace on both sides of the assembly. The slight increase in magnetic circuit resistance is easily counteracted by an increase in the thickness and area of the magnetic blocks 22 and 24, and the configuration assures that typical modern ceramic magnets of high coercive force are utilized in the region of their maximum energy product. The presence of magnetic blocks on both sides of the pole pieces 12 and 14 is important as it reduces the free surface of these pole pieces, and therefore greatly reduces the level of leakage flux not in the useful gap 16.

The sound beam produced by this system is laterally very broad due to the narrow width of the source. In the vertical direction the angular spread is extremely small at the higher frequencies, but the height of the beam is equal to the height, or length, of the ribbon element. When the loudspeaker, cabinet and ribbon are all between 4 and 6 feet in length, listeners may remain in the beam be they seated on the floor, on chairs or couches, or standing. Thus, they hear the full frequency response of the system and obtain unusually good imaging of sources in the customary sterophonic set-up.

PRIOR ART STATEMENT

Prior art known to applicant comprise:

| | | |
|---|---|---|
| Gerlach | (1925) | 1,557,356 |
| Sykes | (1926) | 1,594,802 |
| Sykes | (1927) | 1,637,397 |
| Hartmann | (1936) | 2,047,777 |
| Anderson | (1939) | 2,147,137 |
| Kennedy | (1939) | 2,164,157 |
| Cowley | (1941) | 2,233,886 |
| Anderson | (1960) | 2,963,557 |
| Heppner | (1966) | 3,234,339 |
| Hobrough | (1971) | 3,564,163 |
| Bleazey | (1971) | 3,619,517 |
| Beveridge | (1972) | 3,668,335 |
| Beveridge | (1973) | 3,773,976 |
| Beveridge | (1976) | 3,980,829 |
| Kasatkin | (1977) | 4,001,522 |
| Kasatkin | (1977) | 4,001,523 |
| Dahlquist | (1977) | 4,020,296 |
| Kasatkin | (1977) | 4,027,111 |
| Kasatkin | (1977) | 4,049,926 |

Applicant believes that none of the prior art known to him and listed above negatives invention herein as set forth in the claims.

Variations and modifications of the present invention will be apparent and readily recognizable to those skilled in the pertinent art. All such as fall within the spirit and scope of the following claims liberally construed are intended to be protected by this patent.

What is claimed is:

1. In a ribbon-type acoustic speaker system wherein an elongated sound-reproducing ribbon extends lengthwise along a working gap between an opposed pair of elongated magnetic pole pieces, the improvement comprising:

means providing a plurality of supports adjacent said ribbon and spaced apart along its length;

resilient means fixed between said ribbon and said supports; and said resilient means being shaped to provide lengthwise gradation of resilience from relatively greater firmness medially to less firm ends.

2. The structure of claim 1 in which the resilient means each have greater mass medially and taper therefrom endwise.

3. The structure of claim 1 in which the resilient means is derived from polyurethane.

4. The structure of claim 1 in which the resilient means is derived from a felt of fibers.

5. The structure of claim 1 in which the resilient means is adhesively affixed to said ribbon and to said supports.

6. The structure of claim 5 in which the ribbon is wavy and said resilient means is adhesively affixed to at least an adjacent pair of waves.

7. The structure according to claim 6 in which the magnetic pole pieces support, spaced from said working gap, a series of permanent magnet blocks, magnetised in directions perpendicular to the transverse axes of said pole pieces.

8. The structure according to claim 7 in which the magnet blocks are ceramic magnets.

9. A ribbon-type acoustic speaker system, comprising:

an elongated pair of flux concentrating magnetic structures in edge-opposed, spaced-apart relation providing a working gap between pole pieces;

a sound-reproducing ribbon extending lengthwise of said working gap between said pole pieces;

support means spanning said working gap adjacent said ribbon; and resilient means affixed in spaced-apart ribbon-supporting relation between said ribbon and said spanning support means.

10. A ribbon-type acoustic speaker system, comprising:

an elongated pair of magnetically soft bars mounted in edge-opposed, spaced-apart relation and thereby providing a working gap;

a series of permanently magnetic blocks secured along and sandwiching said bars in a location spaced from the edges of said soft bars defining said working gap; and a resiliently supported ribbon mounted in said working gap.

11. The structure according to claim 10 in which there is wooden fairing means adjacent the working gap serving to smooth paths of reproduced sound.

12. The structure according to claim 11 in which the portions of said blocks remote from said working gap overlap the edge of each bar remote from said working gap and form a groove tending to reduce leakage flux.

13. In an upright ribbon-type acoustic speaker system wherein an elongated sound-reproducing ribbon extends lengthwise along a working gap between an opposed pair of elongated magnetic pole pieces, the improvement comprising:

means providing a plurality of supports transversely adjacent said ribbon and spaced apart along its length;

resilient cellular elements fixed between said ribbon and said supports; and each of said resilient elements including a medial mounting portion secured to a support and end portions of gradually reducing dimensions above and below said support.

14. The structure according to claim 13 in which the resilient elements are diamond shaped and the pointed ends thereof extend above and below said support.

15. The structure according to claim 13 in which said resilient cellular elements are formed of polyurethane foam material.

* * * * *